United States Patent [19]

Jackson

[11] 4,194,482

[45] Mar. 25, 1980

[54] SELF GENERATING IGNITION SYSTEM

[75] Inventor: Robert V. Jackson, Los Angeles, Calif.

[73] Assignee: McCulloch Corporation, Md.

[21] Appl. No.: 908,720

[22] Filed: May 23, 1978

[51] Int. Cl.[2] ..... F02P 1/00

[52] U.S. Cl. ..... 123/148 CC; 123/149 D; 123/148 DS; 315/209 CD; 123/117 R

[58] Field of Search ..... 123/148 CC, 148 DS, 123/148 AC, 148 R, 148 E, 117 R, 149 D, 149 R, 149 FA, 149 C; 315/209 CD, 209 SCR, 218; 310/153, 208

[56] References Cited

U.S. PATENT DOCUMENTS

| | | | |
|---|---|---|---|
| 2,898,392 | 8/1959 | Jaeschke | 123/148 E |
| 3,484,677 | 12/1969 | Piteo | 123/148 E |
| 3,762,383 | 10/1973 | Richards et al. | 123/148 E |
| 3,958,546 | 5/1976 | Ohki et al. | 123/149 R |
| 4,099,509 | 7/1978 | Hashimoto | 123/148 AC |
| 4,120,277 | 10/1978 | Ehlen | 123/117 R |

*Primary Examiner*—Ronald H. Lazarus
*Assistant Examiner*—P. S. Lall
*Attorney, Agent, or Firm*—Finnegan, Henderson, Farabow, Garrett & Dunner

[57] ABSTRACT

The several embodiments of the self-generating breakerless ignition system disclosed herein are each comprised of a rotor structure with a permanent magnet which induces voltages in a plurality of windings, three cascaded semi-conductor switching elements to control the current in the windings, a trigger signal which is provided by one of the windings and which activates the switching elements at a predetermined time, and means which simultaneously supply positive and negative biasing to the switching elements to enhance the switching procedure.

15 Claims, 9 Drawing Figures

Fig. 4
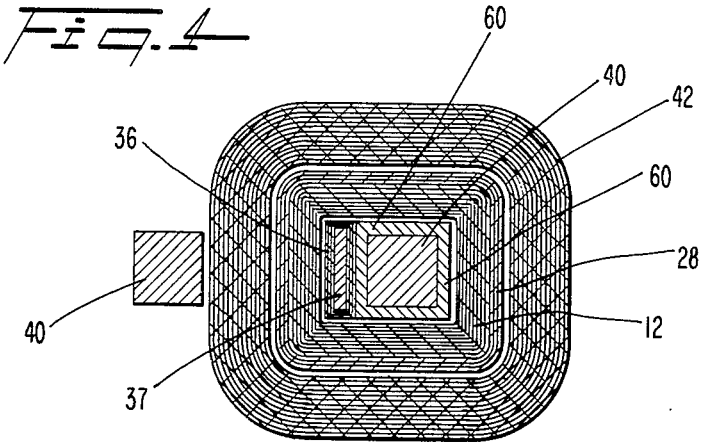
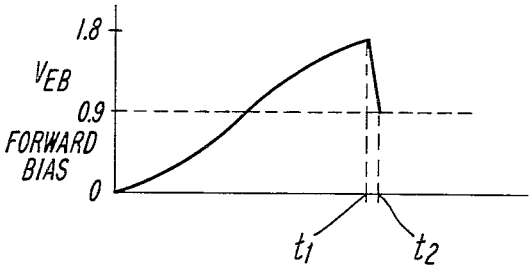
Fig. 5A
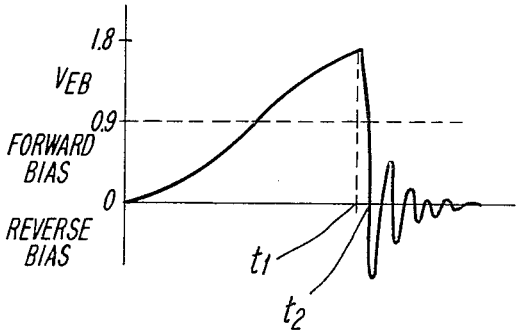
Fig. 5C
Fig. 5B
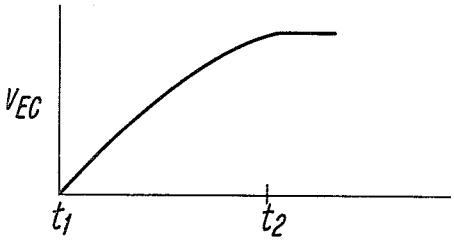
Fig. 5D
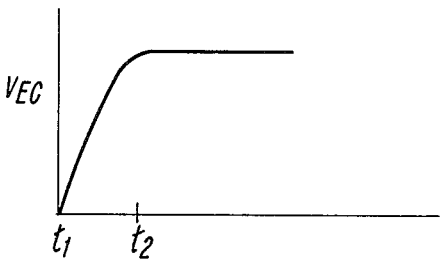

SELF GENERATING IGNITION SYSTEM

BACKGROUND OF THE INVENTION

Magneto ignition systems are based upon the electrical principle that a voltage is generated in any conductor which is subjected to a change in magnetic flux through the conductor. More specifically, a sudden change of the magnetic flux in the core upon which a conductor is mounted will induce a high voltage which can be applied to a spark gap for fuel ignition.

The conventional ignition systems for internal combustion engines have used cam actuated breaker points. The breaker points physically break the magneto coil circuit to induce a high voltage at the proper time in the engine cycle to cause sparking action at the spark plug. With the advent of solid-state switching circuits, many designers in the ignition art recognized the advantages of substituting such circuits for the breaker points. Various electronic circuits, including transistors and silicon controlled rectifiers (SCR), were used in place of the breaker points to interrupt the current to the magneto or primary winding. The use of an auxiliary pick-off coil to trigger the switching action of the electronic circuit also was implemented as an appropriate means to control the timing of the switching action.

In U.S. Ser. No. 790,704, now U.S. Pat. No. 4,120,277 filed May 25, 1977 there is described a breakerless magneto device which utilizes primary and trigger windings mounted on separate cores. The core upon which the auxiliary trigger coil is mounted is located close to the main magneto core for reasons of spark timing, but is operationally substantially isolated magnetically therefrom. A thyristor and a semiconductor circuit such as Darlington connected transistors act as switching elements for interrupting the current in the primary winding of the magneto.

SUMMARY OF THE INVENTION

The present invention provides an improved magneto ignition system comprised of a first core having a first winding mounted thereon, a second core adjacent the first core and having a second winding mounted thereon, and a rotor structure having a permanent magnet which produces a varying flux field in the first and second cores. A third winding is mounted on the first core. A primary circuit including semiconductor devices is provided for current buildup in the first winding. The voltage pulse generated in the second winding due to the varying flux field of the rotating permanent magnet is applied as a trigger signal to a solid-state device such as a silicon controlled rectifier which interrupts the current in the primary circuit at or near its maximum value thereby changing the flux field. A biasing voltage is provided from the third winding to the switching element, the semiconductor circuit, to enhance and facilitate the interruption of current in the primary circuit.

BRIEF DESCRIPTION OF THE DRAWINGS

In the drawings.

FIG. 4 is a sectional view of FIG. 3, showing the placement of the windings on the cores.

FIG. 5A is a graphical representation of the emitter to base voltage during switching in a circuit without the improvement of the present invention.

FIG. 5B is a graphical representation of the emitter to collector voltage rise during switching in a circuit without the improvement of the present invention.

FIG. 5C is a graphical representation of the emitter to base voltage during switching in a circuit showing the improved switching time using the present invention.

FIG. 5D is a graphical representation of the emitter to collector voltage rise during switching in a circuit with the improvement of the present invention.

DESCRIPTION OF THE PREFERRED EMBODIMENTS

Reference will now be made in detail to the preferred embodiments of the invention, examples of which are illustrated in the accompanying drawings.

Figure 1:
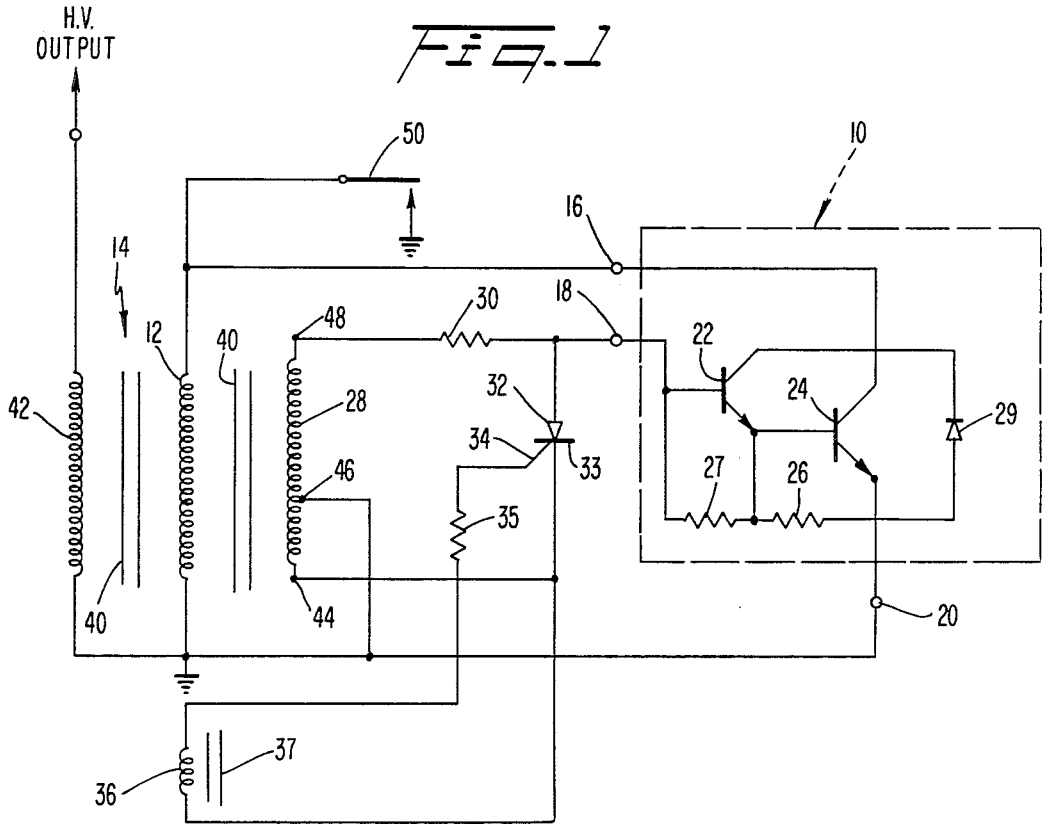
FIG. 1 is a circuit diagram of a preferred embodiment of the present invention.

Referring to FIG. 1, there is shown a circuit diagram for the breakerless ignition system of this invention. In accordance with the invention a semiconductor circuit 10 is connected across the terminals of a first winding, primary winding 12, of magneto coil 14. Preferably semiconductor device 10 has first, second and third terminals 16, 18 and 20 respectively which, for instance, can be the collector, base and emitter of circuit 10.

As here embodied, semiconductor circuit 10 includes first and second transistors 22 and 24 respectively, connected in a Darlington arrangement. The collector and base of first transistor 22 serve as the first and second terminal 16 and 18 respectively of semiconductor circuit 10. The emitter of first transistor 22 is connected to the base of second transistor 24 and to one end of resistance 26. The other end of resistance 26 is connected to the emitter of second transistor 24 which also serves as third terminal 20 of semiconductor circuit 10. Resistance 27 is connected between base and emitter of transistor 22.

Preferably the semiconductor circuit 10 further includes a diode 29 connected across the collector and the emitter of second transistor 24. Diode 29 serves to bypass the reverse direction current which is generated in the primary winding 12.

According to the invention, means responsive to a voltage to switch from a nonconductive to a conductive state is connected in series with a section of a winding 28 across terminals 18 and 20 of semiconductor circuit 10. Such means can be a thyristor, and as herein embodied, is a silicon controlled rectifier (SCR) 32. Silicon controlled rectifier 32 has a gate 34 connected through resistance 35 to one end of a second winding, trigger coil 36, which is mounted on core 37. The other end of second winding 36 is connected to the cathode 33 of silicon controlled rectifier 32.

As herein embodied, base terminal 18 of semiconductor circuit 10 is connected to one side 48 of a third winding, bias supply winding 28, through resistance 30. The other side 44 of third winding 28 is connected to the cathode 33 of silicon controlled rectifier 32 and a tap 46 on third winding 28 is connected to terminal 20 of semiconductor circuit 10. As herein embodied core 40 is provided on which the first winding, primary winding 12, and the third winding, bias supply winding 28, are mounted.

Preferably means is provided for completing a circuit through primary winding 12 which can include semiconductor circuit 10 with collector and emitter terminals 16 and 20 respectively of semiconductor circuit 10 connected to the ends of primary winding 12.

With reference to FIG. 1 and as herein embodied, switch 50 connects one end of first winding 12 to ground. When switch 50 is closed, primary winding 12 is shorted out and the circuit is shut off.

As shown in FIG. 1 secondary winding 42 is provided with a high voltage output which is typically connected to an engine fuel ignition means such as a spark plug (not shown). The current generated in the first winding, primary winding 12, and switched through semiconductor circuit 10 produces a magnetic field affecting the common core 40 of the primary and secondary windings 12 and 42 inducing the high voltage output in the secondary winding.

In accordance with the invention, means responsive to the varying flux through core 40, here embodied as third winding 28, provides a reverse bias voltage to semiconductor circuit 10 to facilitate the interruption of current therethrough. As herein embodied in FIG. 1, a portion of third winding 28 is connected in series between the cathode of silicon controlled rectifier 32 and emitter terminal 20 of semiconductor circuit 10. The cathode of silicon controlled rectifier 32 is connected to a first terminal 44 of third winding 28. A second terminal, tap terminal 46 is connected to terminal 20 of the semiconductor circuit 10. Second terminal 46 of third winding 28 is intermediate to first terminal 44 and a third terminal 48 of third winding 28. The terminal 46 is connected to third winding 28 to provide a reverse voltage responsive to the varying flux in core 40 which is greater than the forward voltage drop of the silicon controlled rectifier under all conditions of operation.

Third winding 28 can be constructed as two separate windings or can be a single winding with a tap terminal as in FIG. 1 which produces two simultaneous voltages. A forward bias voltage developed on a first section between terminals 46, 48 is applied across terminals 18 and 20 of semiconductor circuit 10 for turning on and driving the circuit. Simultaneously and in phase opposition to the forward bias voltage, a reverse bias voltage is produced on a second section between terminals 46 and 44 which is applied in series between silicon controlled rectifier 32 and semiconductor circuit 10. The reverse bias voltage is chosen to exceed the forward voltage drop of controlled rectifier 32 to provide a reverse bias voltage on the emitter to base junction of the semiconductor circuit 10 when rectifier 32 is turned on.

The breakerless ignition system of the present invention operates as follows: A forward bias voltage generated across the portion of third winding 28 defined between terminals 46 and 48 is applied to semiconductor circuit 10, and the Darlington arrangement is turned on and current is conducted in the primary circuit. When a trigger signal is applied from second winding 36 to the gate of silicon controlled rectifier 32, the forward voltage drop of rectifier 32 will be less than the opposing bias voltage and the voltage between emitter 20 and base terminal 18 of semiconductor circuit 10 will swing negative turning semiconductor circuit 10 off. The negative value of the base emitter voltage is determined by the voltage generated in the tap portion of third winding 28 between terminals 44 and 46.

Figure 2A:
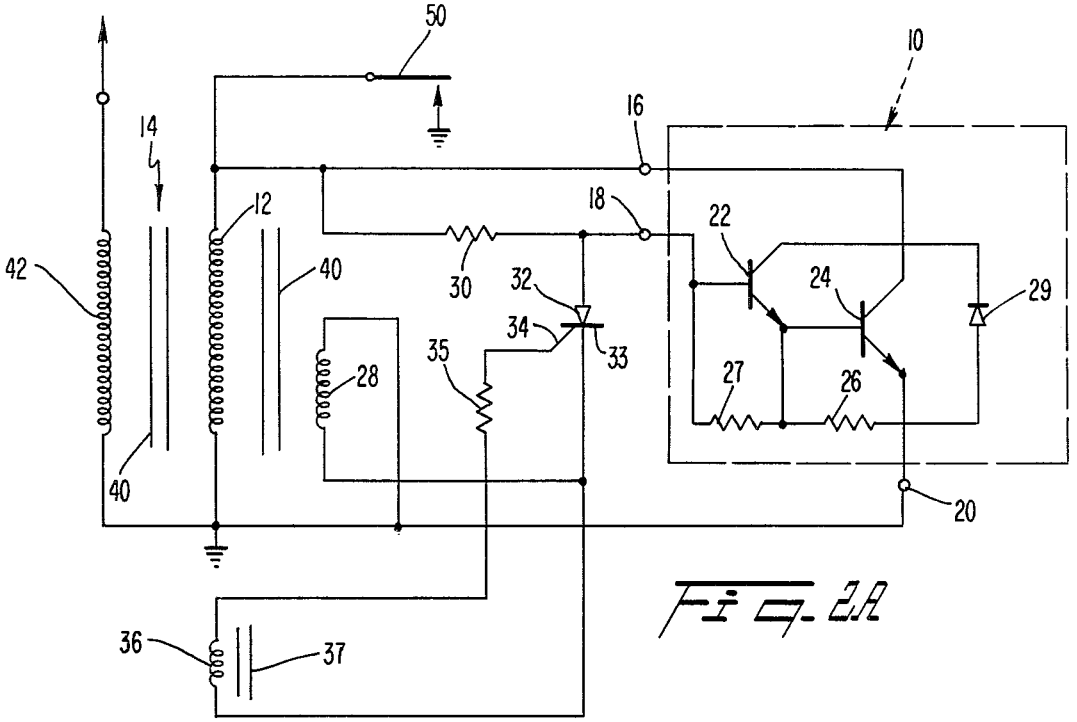
FIG. 2A is a circuit diagram of another preferred embodiment of the present invention.
Figure 2B:
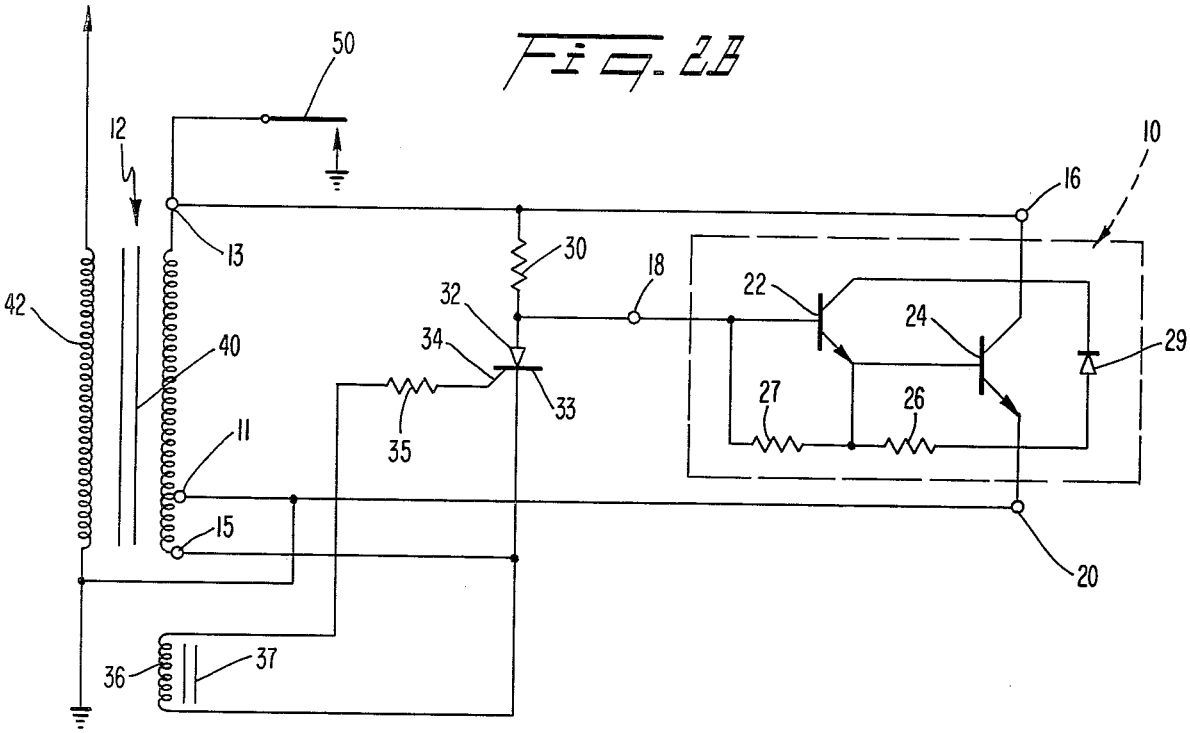
FIG. 2B is a circuit diagram of another preferred embodiment of the present invention.

Second and third preferred embodiments of the breakerless ignition system of the present invention are depicted in FIGS. 2A and 2B. Like elements of the circuit as shown in FIG. 1 have been identified by the same symbols. In FIG. 2A the circuit has been modified to eliminate a portion of third winding 28 and thereby to simplify the circuit. Further, resistance 30, which is the base current limiting resistor, is connected to first winding, primary winding 12, rather than to third winding 28. Primary winding 12 provides the forward bias voltage through resistance 30 to turn on and drive semiconductor circuit 10. The voltage generated by first winding 12 provides an ample forward bias to turn semiconductor circuit 10 on and thereby eliminates the need for a major portion of third winding 28.

The breakerless ignition system according to FIG. 2A is simpler to manufacture since third winding 28 has been decreased in size. However, the forward bias voltage for turning on semiconductor circuit 10 is only available from the fixed number of turns in first winding 12 and the voltage can not be independently varied from that value. With the circuit as shown in FIG. 1 the portion of the third winding between terminals 46 and 48 controls the forward bias for turning on and driving semiconductor circuit 10. Consequently, the power and voltage for driving semiconductor circuit 10 can be regulated independently of the primary winding. Nonetheless, in the usual applications the circuit of FIG. 2A provides ample power capability from first winding 12 for driving semiconductor circuit 10.

A preferred embodiment in which a third winding is not required is shown in FIG. 2B. A first section of first winding 12 between terminals 11 and 13 is connected in series with resistance 30 across terminals 18 and 20 to drive semiconductor circuit 10. The voltage generated between terminals 11 and 13 of first winding 12 provides a forward bias drive to semiconductor circuit 10 as was done in the embodiment of FIG. 2A.

A second section of first winding 12 which is tapped off between terminals 11 and 15 is connected in series between cathode 33 of the silicon controlled rectifier 32 and terminal 20 of semiconductor circuit 10. The voltage across the second section of first winding 12 is selected to be greater in magnitude than the forward voltage of silicon controlled rectifier 32 and is connected to oppose such forward voltage so that the voltage across terminals 18 and 20 is reversed during current interruption.

It will be appreciated that multiple magnets in the rotor and distributor means can be provided where a multiple cylinder internal combustion engine is used for any of the embodiments of FIGS. 1, 2A and 2B. The voltage produced in the secondary winding 42 can then selectively be applied to each spark plug corresponding to the respective cylinders of the internal combustion engine.

Figure 3:
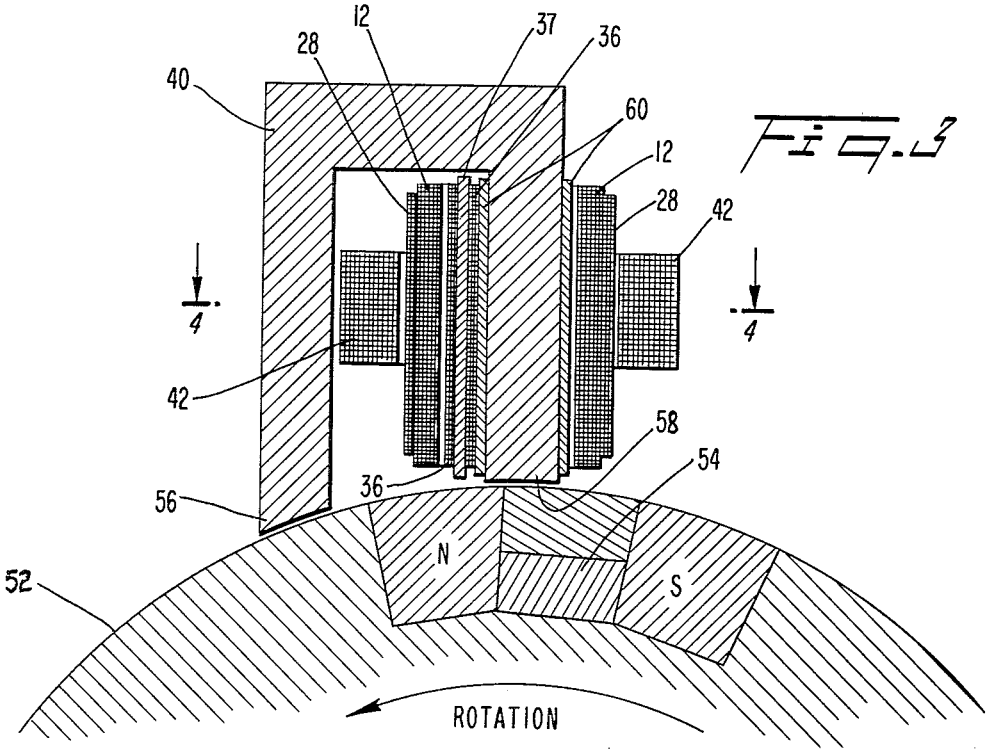
FIG. 3 is a cross-sectional representation of the core and coil structures of an embodiment of the present invention.

The construction of the first and second cores 40 and 37, the magneto and trigger cores respectively, and their respective windings is shown in FIGS. 3 and 4. As herein embodied the rotor 52 of a nonmagnetic material has a permanent magnet 54 embedded in its periphery for providing a rotating field or source of flux for the magneto system. It will be appreciated that variations can be made in the configuration of the magnet 54 and rotor 52 without varying from the concept taught in this invention.

Rotor 52 is usually mounted directly on the shaft of the internal combustion engine, and as shown here, rotates in a counterclockwise direction in synchronism with the engine. The air gap between first core 40 and rotor 52 is minimized so that the total reluctance of the magnetic circuit, when the poles of magnet 54 are aligned respectively with the legs of core 40, is small. When the poles of magnet 54 are aligned with the end portions of legs 56 and 58 of core 40, most of the flux from the rotating field member passes through first core 40.

Preferably and as herein embodied, the second core 37 having second winding 36 mounted thereon is positioned next adjacent and spaced from first core 40. This can be achieved by placement of an insulating spacer 60 between the second winding 36 and first core 40.

As herein embodied the first winding, primary winding 12, is mounted on leg 58 of core 40 to encompass both second core 37 and second winding 36. Preferably second core 37 is positioned parallel to and adjacent leg 58 of core 40.

Third winding 28 is preferably mounted on the first winding, primary winding 12, as shown in FIG. 3. Third winding 28 is wound coaxially with primary winding 12. Secondary winding 42 as here shown in mounted on third winding 28. Each of the respective windings, first winding 12, third winding 28 and secondary winding 42 are mounted concentric with leg 58 of core 40. Insulating spacers such as 60 are used to position the respective windings in proper relationship to one another and to core 40.

Second core 37 and second winding 36 are positioned inside and adjacent first leg 58 so that a voltage pulse is generated in second winding 36 at the time that the current in primary winding 12 is substantially at its maximum value. The trigger voltage pulse is applied to gate terminal 34 of silicon controlled rectifier 32 placing it in a conductive state. The flow of current through primary winding 12 is thereby interrupted.

At the instant that switching occurs, base terminal 18 of semiconductor circuit 10 goes from a forward bias voltage to a reverse bias voltage with respect to emitter terminal 20. This causes semiconductor circuit 10 to rapidly switch off because the charge carriers are driven by the reverse bias. The result is a switching time which is a fraction of the switching time achieved when a forward bias level remains on semiconductor circuit 10 after switching. Additionally the reverse bias between base 18 and emitter 20 momentarily raises the hold off voltage or the break over voltage of the emitter collector simultaneously with the arrival of increasing voltage from the first winding, primary winding 12, immediately after switching has occurred. Rather than the emitter collector breaking over, it is now held off to a higher voltage and the circuit is allowed to oscillate slightly between the emitter and base providing essentially an oscillating bias in unison with the voltage applied from primary winding 12 to the emitter collector of semiconductor circuit 10. This causes a ringing in the secondary output voltage which enhances the operation of the device.

The improvement in operation of the magneto ignition system is best shown by comparing FIGS. 5A and 5B with FIGS. 5C and 5D. In FIGS. 5A and 5B the emitter to base voltage and emitter to collector voltage respectively are shown for a device which does not provide a reverse bias voltage to semiconductor circuit 10 during turn off. The voltage generated in third winding 28 that is applied across base terminal 18 and emitter terminal 20 of semiconductor circuit 10 is shown to increase to a typical value of 1.8 volts. When triggering occurs at time $T_1$, silicon controlled rectifier 32 turns on and the emitter to base voltage drops to about 0.9 volts positive in a time $T_1$ to $T_2$. The relative switching time is shown in FIG. 5B by plotting the emitter to collector voltage rise. The emitter to collector voltage of semiconductor circuit 10 goes from a low value in the on condition at time $T_1$ to a maximum voltage at time $T_2$ determined by circuit conditions imposed upon the emitter collector of the Darlington arrangement. The switching time ($T_1$ to $T_2$) is typically of the order of 2 to 3 microseconds.

In FIGS. 5C and 5D there is shown the emitter to base voltage and the emitter to collector voltage respectively for a circuit according to the present invention utilizing means to provide a reverse bias voltage to semiconductor circuit 10 during turn off. The emitter to base voltage rises during the on condition of the circuit to a typical value of 1.8 volts. When triggering occurs at time $T_1$, silicon controlled rectifier 32 turns on and the emitter to base voltage is driven negative by an amount that is determined by the number of turns of third winding 28 between terminals 44 and 46 as shown in FIG. 1.

The rise time of the emitter to collector voltage of semiconductor circuit 10 shown in FIG. 5D is decreased appreciably by the use of reverse biasing. Whereas the rise time ($T_2-T_1$) shown in FIG. 5B typically is between two and three microseconds, when switching is accomplished in a circuit according to that of FIGS. 1, 2A or 2B it can be accomplished in less than one microsecond, typically 0.8 microsecond. The faster switching time results in lower switching losses and less heating. A greater output from the secondary due to lower power losses and the faster rate of current change in the primary winding 12 is thereby achieved.

If an increased reverse bias is applied across the emitter to base junction of semiconductor circuit 10, the break-over voltage between the emitter and collector increases. The circuits according to either FIGS. 1, 2A or 2B allow a reverse bias voltage to be applied to the base to emitter junction of semiconductor circuit 10 at the rate of application of emitter to collector voltage after semiconductor circuit 10 is shutoff. Accordingly it is possible to achieve hold off voltages with this circuit under momentary biasing conditions that are substantially higher than the voltage ratings of the transistors.

The reverse biasing of the base to emitter junction of semiconductor circuit 10, as described above, occurs because of the structure of the windings. Third winding 28 is wound concentric with first winding 12 which produces the voltage which appears across the emitter collector terminals of semiconductor circuit 10. When a voltage is generated in first winding 12, a voltage is also generated in third winding 28 since they are wound coaxially on the same core 40.

What we claim is:

1. A magneto ignition system for use with an internal combustion engine, comprising:

a first core, a first winding mounted on said first core across which a primary voltage is generated responsive to flux in said first core, switching means connected across said first winding for completing a circuit through said first winding, a secondary high voltage winding mounted on said first core for generating a voltage output for said ignition system, a second core positioned next adjacent and spaced from said first core, a second winding mounted on said second core, a rotor having a permanent magnet for producing varying flux through said first and second cores to induce voltages across the respective first winding and second winding, means responsive to the voltage generated in said second winding for interrupting the flow of current through said circuit means, and means responsive to said varying flux through said first core for simultaneously generating (i) a reverse bias voltage in series with said voltage responsive means applied across said switching means and (ii) a forward bias voltage applied across said switching means in synchronism with said primary voltage to increase the rate of interruption of current therethrough.

2. The magneto ignition system for use with an internal combustion engine of claim 1, wherein said means responsive to said varying flux through said first core is a third winding with first and second terminals connected respectively to said voltage responsive means and said switching means.

3. The magneto ignition system for use with an internal combustion engine of claim 2, wherein said switching means is a semiconductor circuit having first, second, and third terminals, said first and third terminals of said semiconductor circuit being connected across said first winding, and wherein said third winding is connected in series with said voltage responsive means across said second and third terminals of said semiconductor circuit.

4. The magneto ignition system for use with an internal combustion engine of claim 2 wherein said voltage responsive means includes a thyristor having anode, cathode and gate characterized by a forward voltage drop, and wherein said third winding responsive to the varying flux in said first core produces a reverse bias voltage greater in magnitude than said forward voltage drop of said thyristor.

5. The magneto ignition system for use with an internal combustion engine of claim 4 wherein said switching means includes a semiconductor circuit having first, second and third terminals.

6. The magneto ignition system for use with an internal combustion engine of claim 5 wherein said cathode of said thyristor is connected to said first terminal of said third winding, said second terminal of said third winding is connected to said third terminal of said semiconductor circuit and said second terminal of said semiconductor circuit is connected to said anode of said thyristor.

7. The magneto ignition system for use with an internal combustion engine of claim 5 wherein said semiconductor circuit is first and second transistors connected in a Darlington arrangement and said first winding is connected across said second and third terminals of said semiconductor circuit for driving said circuit on.

8. The magneto ignition system for use with an internal combustion engine of claim 1, wherein said means responsive to said varying flux through said first core is a third winding mounted on said first core having first, second and third terminals, said second terminal being intermediate said first and third terminals, said first and third terminals being connected across said voltage responsive means and said second terminal being connected to said switching means.

9. The magneto ignition system for use with an internal combustion engine of claim 1 further including a unidirectional current carrying element connected across said switching means so polarized to limit reverse voltage across said switching means to the forward voltage drop across said unidirectional current carrying element.

10. A magneto ignition system for use with an internal combustion engine, comprising:

a first core, a first winding mounted on said first core across which a primary voltage is generated responsive to flux in said first core, switching means connected across said first winding for completing a circuit through said first winding, a secondary high voltage winding mounted on said first core for generating a voltage output for said ignition system, a second core positioned inside said first winding next adjacent and spaced from said first core, a second winding mounted on said second core, a rotor having a permanent magnet for producing varying flux through said first and second cores to induce voltages across the respective first winding and second winding, means responsive to the voltage generated in said second winding for interrupting the flow of current through said switching means, and means responsive to said varying flux through said first core for simultaneously generating (i) a reverse bias voltage in series with said voltage responsive means applied across said switching means and (ii) a forward bias voltage applied across said switching means in synchronism with said primary voltage to increase the rate of interruption of current therethrough.

11. A magneto ignition system for use with an internal combustion engine, comprising:

a first core, a first winding mounted on said first core across which a primary voltage is generated responsive to flux in said first core, a semiconductor circuit having first, second and third terminals, the first and third terminals being connected across said first winding for completing a primary circuit therethrough, a secondary high voltage winding mounted on said first core for generating a voltage output for said ignition system, a second core positioned next adjacent and spaced from said first core, a second winding mounted on said second core, means responsive to the voltage generated in said second winding for interrupting the flow of current through said semiconductor circuit, a third winding mounted on said first core having a first section for generating a forward bias voltage and a second section for generating a reverse bias voltage to increase the rate of current interruption in the primary circuit and synchronously vary the bias voltage with the primary voltage across said semiconductor circuit, said first section of said third winding being connected across the second and third terminals of said semiconductor circuit for driving said circuit and said second section of said third winding being connected with said voltage responsive means across the second and third terminals of said semiconductor circuit for applying reverse bias to said circuit, and a rotor having a permanent magnet for producing varying flux through said first and second cores to induce voltages across the respective first, second and third windings.

12. A magneto ignition system for use with an internal combustion engine, comprising:

a first core, a first winding mounted on said first core across which a primary voltage is generated responsive to flux in said first core, a semiconductor circuit having first, second and third terminals, said first and third terminals being connected across said first winding for completing a circuit therethrough, a secondary high voltage winding mounted on said first core for generating a voltage output for said ignition system, a second core positioned next adjacent and spaced from said first core, a second winding mounted on said second core, means responsive to the voltage generated in said second winding for interrupting the flow of current through said semiconductor circuit, a third winding mounted on said first core connected in series with said voltage responsive means across the second and third terminals of said semiconductor circuit for generating a reverse bias voltage which varies synchronously with the primary voltage to increase the rate of current interruption, and a rotor having a permanent magnet for producing varying flux through said first and second cores to induce voltages across the respective first, second and third windings.

13. A magneto ignition system for use with an internal combustion engine, comprising:

a first core, a first winding mounted on said first core across which a primary voltage is generated responsive to flux in said first core, a semiconductor circuit having first, second and third terminals, said first and third terminals being connected across said first winding for completing a circuit therethrough, a secondary high voltage winding mounted on said first core for generating a voltage output for said ignition system, a second core positioned next adjacent and spaced from said first core, a second winding mounted on said second core, means responsive to the voltage generated in said second winding for interrupting the flow of current through said semiconductor circuit, said first winding having a tapped portion connected in series with said voltage responsive means across the second and third terminals of said semiconductor circuit for generating a reverse bias voltage which varies synchronously with the primary voltage to increase the rate of current interruption, and a rotor having a permanent magnet for producing varying flux through said first and second cores to induce voltages across the respective first and second windings.

14. The magneto ignition system of claim 13 wherein said means responsive to the voltage generated in said second winding is a thyristor having anode, cathode and gate characterized by a forward voltage drop, and wherein said reverse bias voltage is greater in magnitude than said forward voltage drop of said thyristor.

15. The magneto ignition system of claim 13 wherein said semiconductor circuit is first and second transistors connected in a Darlington arrangement.

* * * * *